US010955194B2

(12) United States Patent
Glickman et al.

(10) Patent No.: US 10,955,194 B2
(45) Date of Patent: Mar. 23, 2021

(54) ENGINE COOLING SYSTEM

(71) Applicant: Ford Global Technologies, LLC, Dearborn, MI (US)

(72) Inventors: David Brian Glickman, Southfield, MI (US); Sean Terence Coghlan, Dearborn, MI (US); Darshan Arun Nayak, Northville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 185 days.

(21) Appl. No.: 16/216,530

(22) Filed: Dec. 11, 2018

(65) Prior Publication Data

US 2020/0182547 A1 Jun. 11, 2020

(51) Int. Cl.

| | |
|---|---|
| ***F28D 1/04*** | (2006.01) |
| ***F28D 1/047*** | (2006.01) |
| ***F28F 9/26*** | (2006.01) |
| ***F28F 9/013*** | (2006.01) |
| ***F28F 1/10*** | (2006.01) |
| *F28D 1/02* | (2006.01) |

(52) U.S. Cl.

CPC ..... *F28D 1/0461* (2013.01); *F28D 1/0472* (2013.01); *F28F 1/10* (2013.01); *F28F 9/013* (2013.01); *F28F 9/26* (2013.01); *F28D 2001/0273* (2013.01)

(58) Field of Classification Search

CPC .... F28D 1/0472; F28D 1/0443; F28D 1/0477; F28D 1/0478; F28D 1/0426; F28D 2001/0273; F28F 9/013; F28F 9/26; F01P 2003/182; B60K 11/04

See application file for complete search history.

(56) References Cited

U.S. PATENT DOCUMENTS 1,390,899 A * 9/1921 Froelich ..... F01P 3/18 165/125
1,428,718 A * 9/1922 Sturtevant ..... F28D 1/053 165/72
4,062,401 A * 12/1977 Rudny ..... F01P 3/18 165/125
4,377,203 A * 3/1983 Ejima ..... F28D 1/05333 123/41.44
4,510,991 A 4/1985 Kawahira (Continued)

FOREIGN PATENT DOCUMENTS

EP 0036213 A1 * 9/1981 ..... F28D 1/0426

OTHER PUBLICATIONS

Charles, C., "Design of Circular Radiator," Tech Briefs Website, Available Online at https://contest.techbriefs.com/2016/entries/automotive-transportation/7068, Jun. 30, 2016, 2 pages.

*Primary Examiner* — Devon Russell
(74) *Attorney, Agent, or Firm* — David Coppiellie; McCoy Russell LLP

(57) ABSTRACT

Methods and systems are provided for a cooling module assembly for a vehicle. In one example, the cooling module assembly includes a first set of fins configured to flow a first fluid through a first sinusoidal, continuous inner passage, and a second set of fins configured to flow a second fluid through a second sinusoidal, continuous inner passage. The second set of fins shares a common plane with the first set of fins and together forms a semi-circular structure.

18 Claims, 10 Drawing Sheets

(56) References Cited

U.S. PATENT DOCUMENTS

| | | | | |
|---|---|---|---|---|
| 5,765,630 | A * | 6/1998 | Bloomer | F04D 29/582 165/121 |
| 5,832,994 | A * | 11/1998 | Nomura | F28D 1/0213 165/173 |
| 6,145,479 | A * | 11/2000 | Rotter | F01P 3/18 123/41.11 |
| 7,128,136 | B2 * | 10/2006 | Gregory | F28D 1/053 165/151 |
| 2001/0018968 | A1 * | 9/2001 | Klingler | B60H 1/00328 165/140 |
| 2018/0112932 | A1 | 4/2018 | Turney et al. | |

* cited by examiner

ENGINE COOLING SYSTEM

FIELD

The present description relates generally to a cooling module assembly for a vehicle.

BACKGROUND/SUMMARY

A continual demand for improvements to fuel economy and reduction of emissions has driven the automotive market to prioritize production of lightweight and compact vehicles. While strides have been made in reducing fuel consumption and release of undesirable combustion products, packaging of vehicle components within smaller compartment allowances presents a new set of challenges for automotive manufacturers. In particular, a geometry of a vehicle's front end may be dependent on a volume occupied by bulky and heavy components including a cooling system, radiators, active grille shutters (AGS), an air conditioning system, auxiliary coolers, and supporting hardware such as brackets and bolsters.

Engine cooling systems typically comprise at least one radiator and one condenser, the radiator coupled to a vehicle front end and configured to flow to an engine block coolant and the condenser also coupled to the vehicle front end and configured to flow refrigerant to an air conditioning evaporator. The radiator and condenser may have planar, rectangular structures, arranged perpendicular to air flow (e.g., ram-air) in the vehicle front end and stacked along a horizontal direction to allow for simpler packaging. Both the radiator and the condenser may rely on liquid-to-air heat exchange to cool the engine block and an interior of the vehicle, respectively. Transfer of heat from the refrigerant and the coolant to air may be enhanced by using a cooling fan to increase air flow across surfaces of the radiator and the condenser. However, certain regions of the rectangular radiator and condenser, such as the corners, may not be within a sweep of the cooling fan, and may therefore lose heat at a reduced rate.

Furthermore, a positioning of the radiator behind the condenser in the path of ram air results in heating of air by the condenser before the air comes into contact with the radiator. In some examples, auxiliary coolers, such as a charge air cooler, an oil cooler, a transmission fluid cooler, etc., may be positioned between the condenser and the radiator, further reducing a temperature differential between the air flowing to the radiator and the radiator coolant channels and diminishing a cooling capacity of the radiator. To compensate for inefficient heat exchange at the radiator, the radiator size may be increased to augment an available surface area of the radiator for cross-flow heat exchange, further compounding difficulties associated with installing both the enlarged radiator and the condenser within a restricted space.

Attempts to address inefficient cooling resulting from a geometry and positioning of the cooling module assembly includes configuring a heat exchanger to have a circular geometry. One example approach is shown by Kawahira in U.S. Pat. No. 4,510,991. Therein, a heat exchanger, such as a radiator or condenser, may have a plurality of concentrically arranged, circular flat pipes, the pipes adapted with passages for coolant flow therethrough. The concentric, circular flat pipes are co-axially arranged and equidistant apart, each of the circular flat pipes adapted with coolant inlets. Corrugated fins are disposed in the spaces between the circular flat pipes. Alternatively, a single flat pipe may be spirally wound to form a similarly circular heat exchanger with corrugated fins interposed between adjacent portions of the flat pipe. The flat pipe has a single coolant inlet to deliver coolant to the heat exchanger. The circular structure removes inefficiently cooled corners of the heat exchanger are thus removed and an amount of space occupied by a cooling fan may be further reduced by inserting a rotary shaft or motor of the fan into a central aperture of the circular heat exchanger.

However, the inventors herein have recognized potential issues with such systems. As one example, while the circular geometry eliminates regions unaffected by the cooling fan, a positioning of the condenser in front of the radiator nonetheless warms air flowing to the radiator. In addition, the concentric or spiraling geometry of the flat pipe(s) of the circular heat exchanger may not have sufficient surface area in contact with ram air to extract enough heat from the coolant or refrigerant to maintain a cooling capacity of the radiator or cabin air conditioning system, respectively. As a result, an engine temperature may rise above a target operating range unless a larger fan is used.

In one example, the issues described above may be addressed by a method for an integrated cooling system, including an upper and a lower support bracket, and a passage assembly including a first continuous passage coupled to the upper bracket as a first meander line having a first radius, the first passage circulating a first fluid; and a second continuous passage coupled to the upper bracket as a second meander line having a second radius, larger than the first radius, the second passage circulating a second fluid, wherein the first passage is co-planar with the second passage. In this way, both the condenser and radiator receive increased cooling from contact with ram-air while maintaining effective heat exchange across all regions of the cooling module assembly.

As one example, the radiator, formed from a first set of passages, and the condenser, formed from a second set of passages, may together provide a semi-circular cooling module assembly with the radiator and condenser sharing a common plane. The cooling module assembly may receive ram air across the plane of the cooling module assembly, in a direction perpendicular to the plane, allowing the radiator to be cooled by air that has not previously extracted heat from the condenser. By configuring the cooling module assembly with the condenser circumferentially surrounding the radiator, an amount of space occupied by the cooling pack in a vehicle's front end may be reduced.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 4 shows a rear view of the cooling module assembly, including directions of fluid flow there-through.

FIGS. 2-11 are shown approximately to scale.

DETAILED DESCRIPTION

Figure 1:
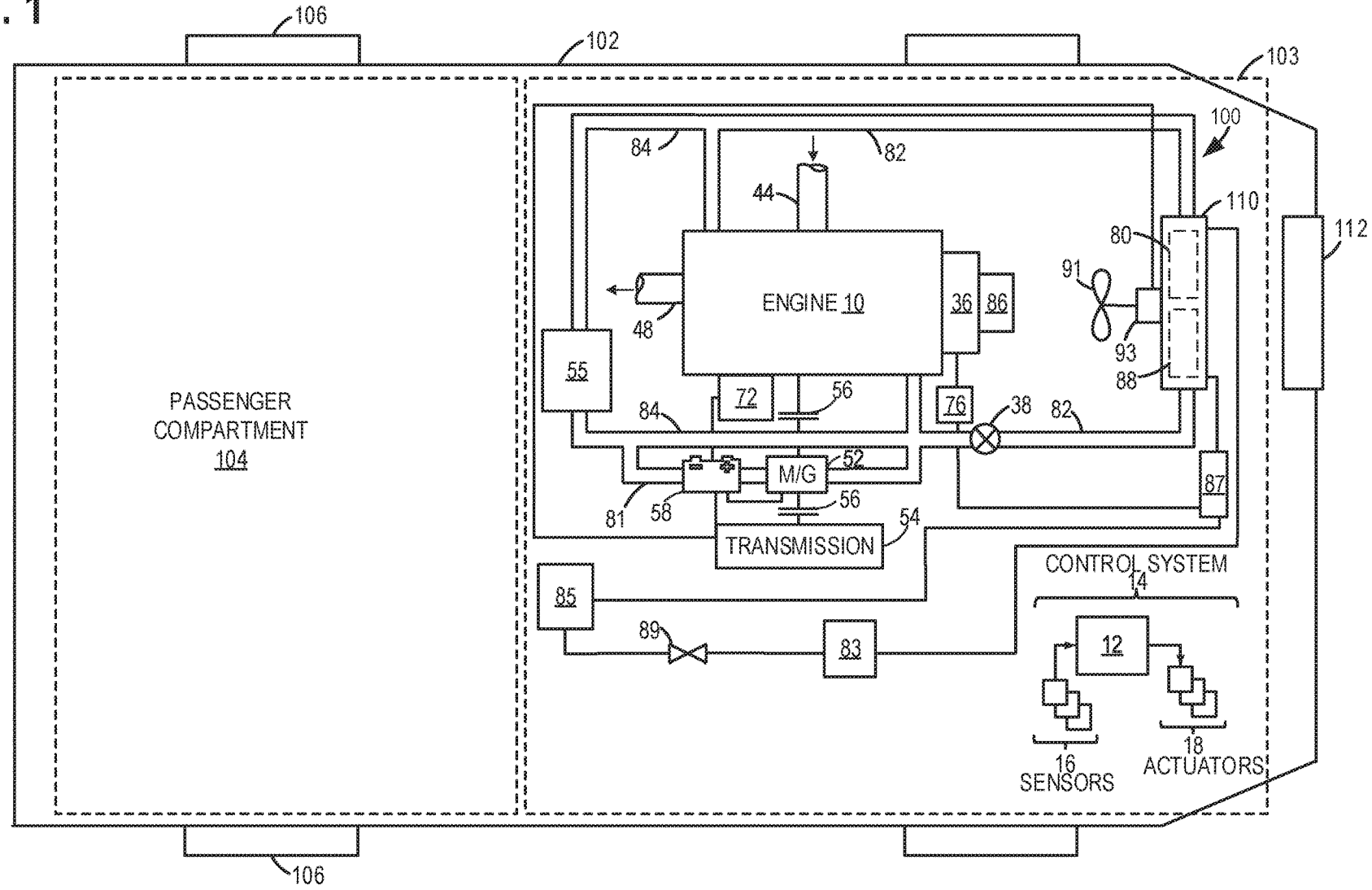
FIG. 1 shows a schematic diagram of an example of a vehicle including an associated cooling system.
Figure 4:
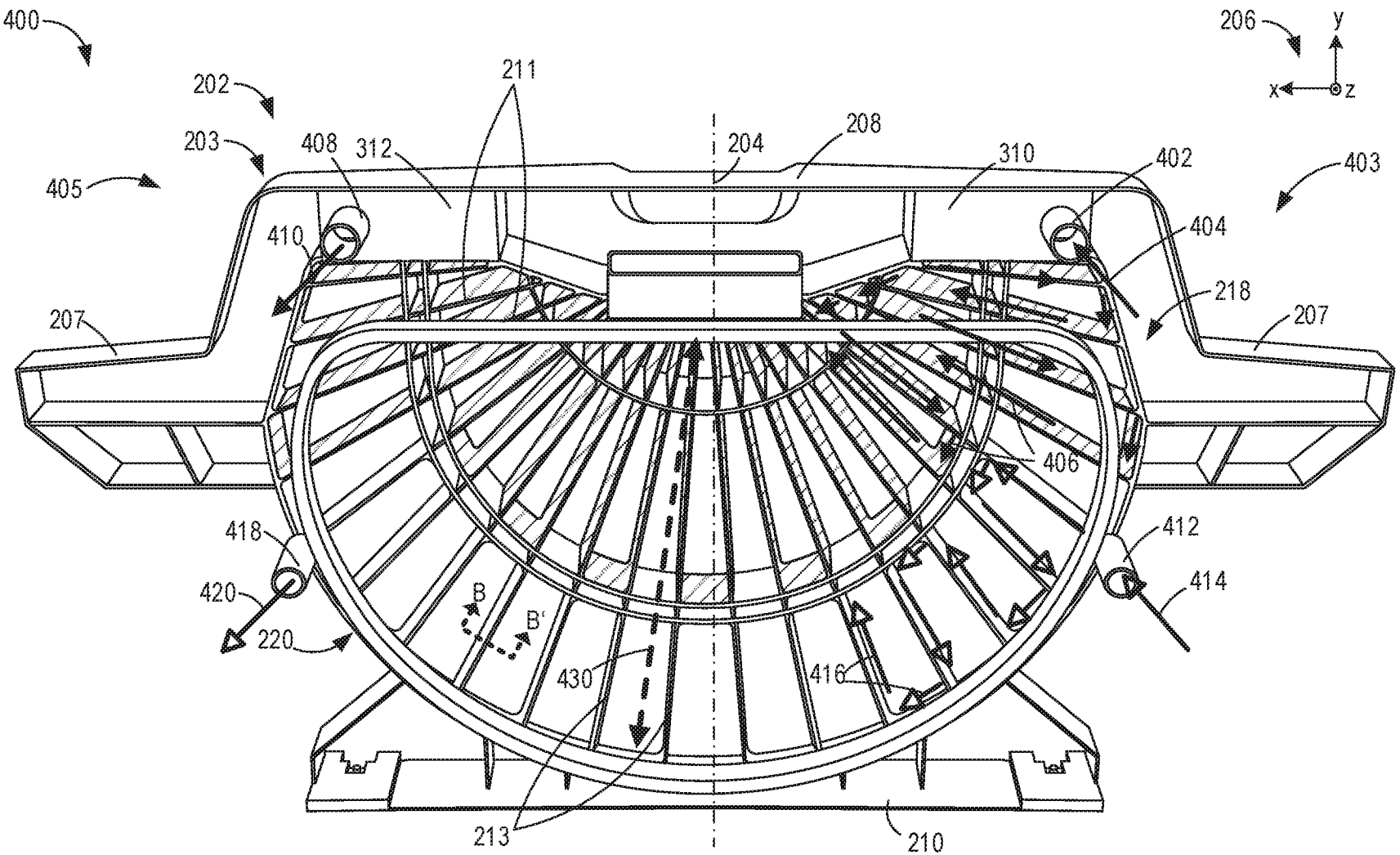
Figure 5:
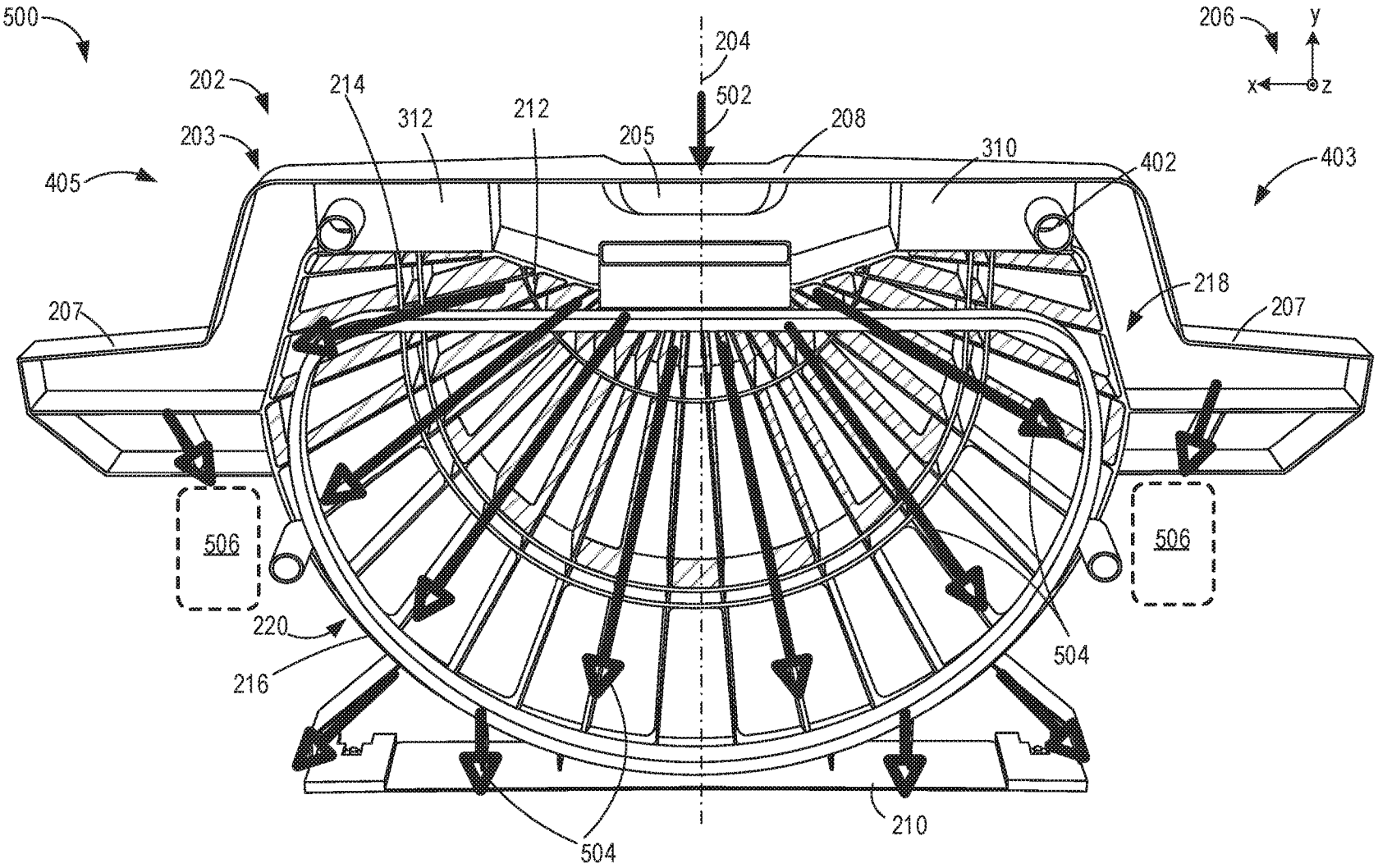
FIG. 5 shows a rear view of the cooling module assembly, including load dispersion through a structure of the cooling module assembly.
Figure 6:
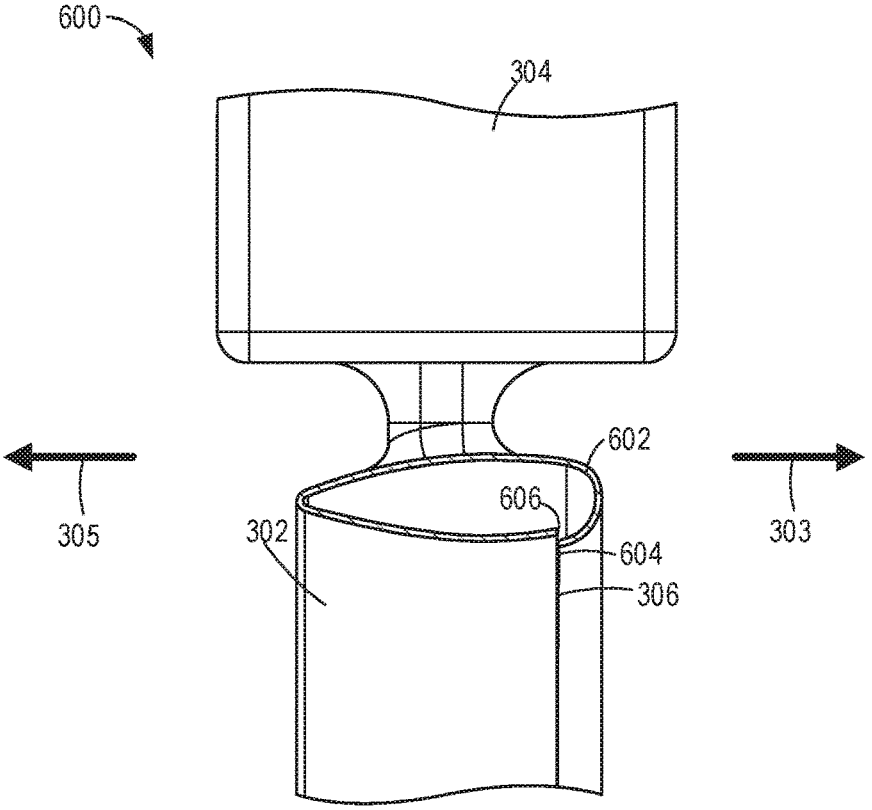
FIG. 6 shows a perspective view of a cross-section of a fan tube of the cooling module assembly.
Figure 9:
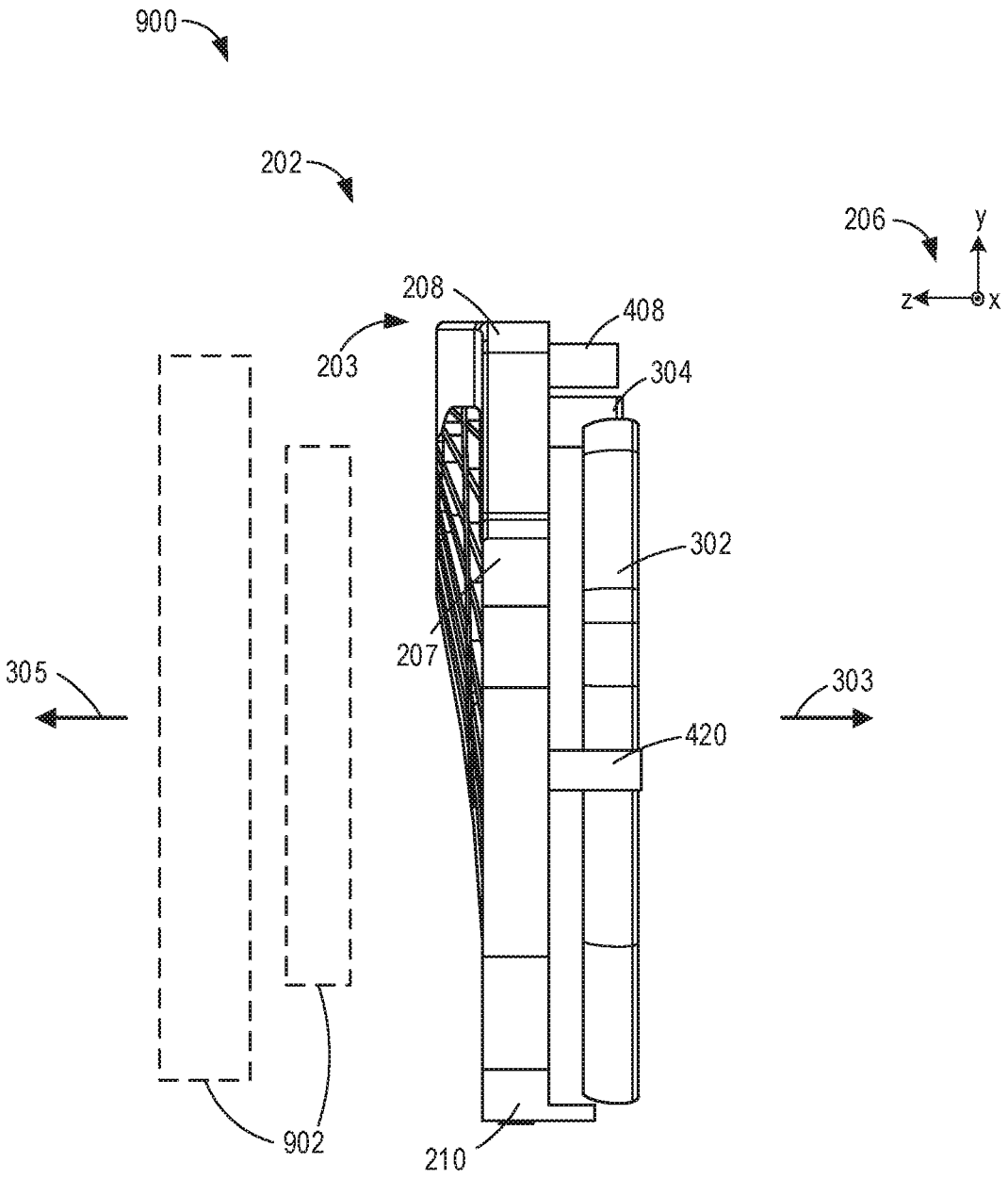
FIG. 9 shows a profile view of the cooling module assembly.
Figure 10:
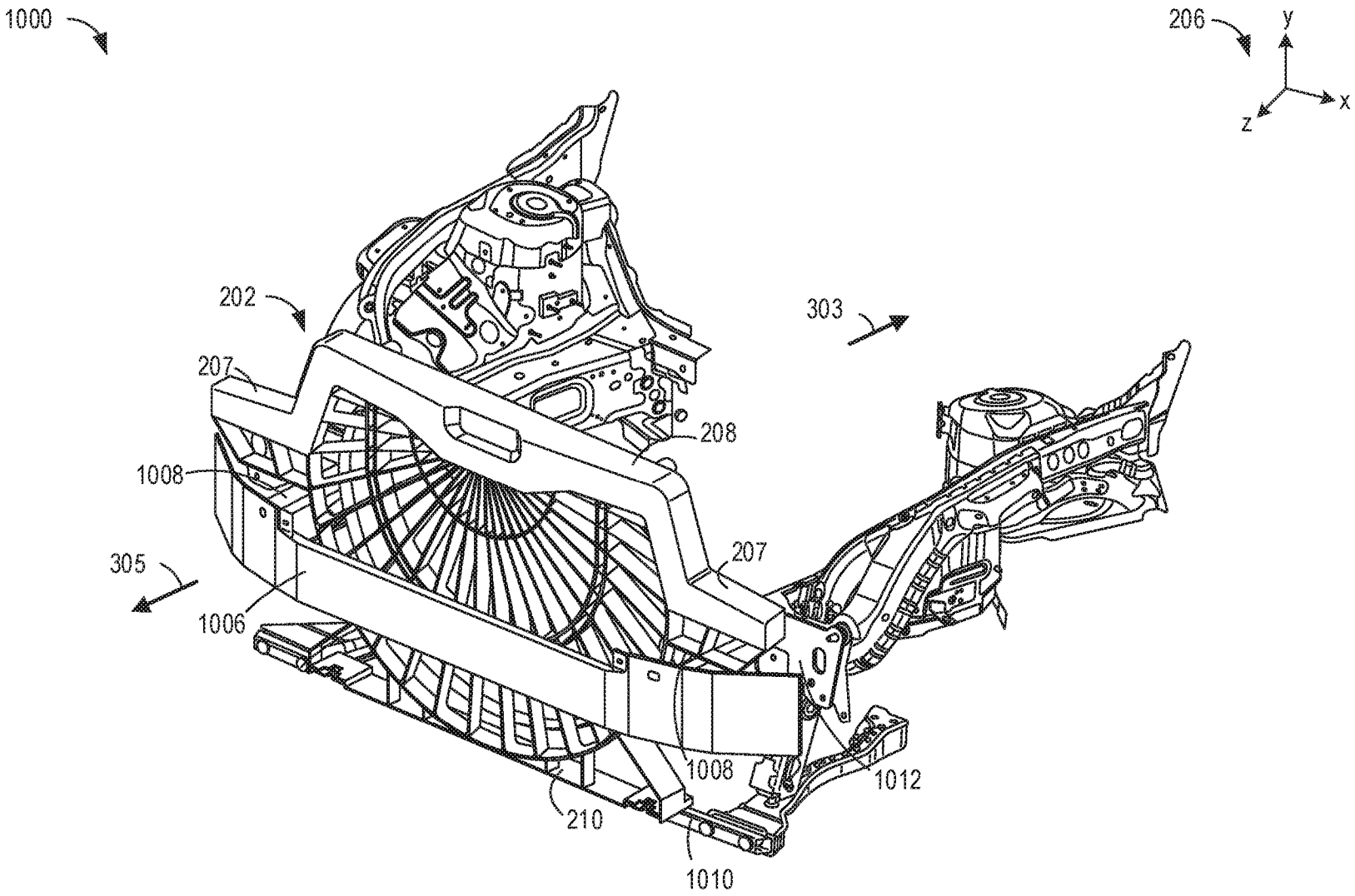
FIG. 10 shows a perspective view of components of a vehicle front end, including the cooling module assembly.
Figure 11:
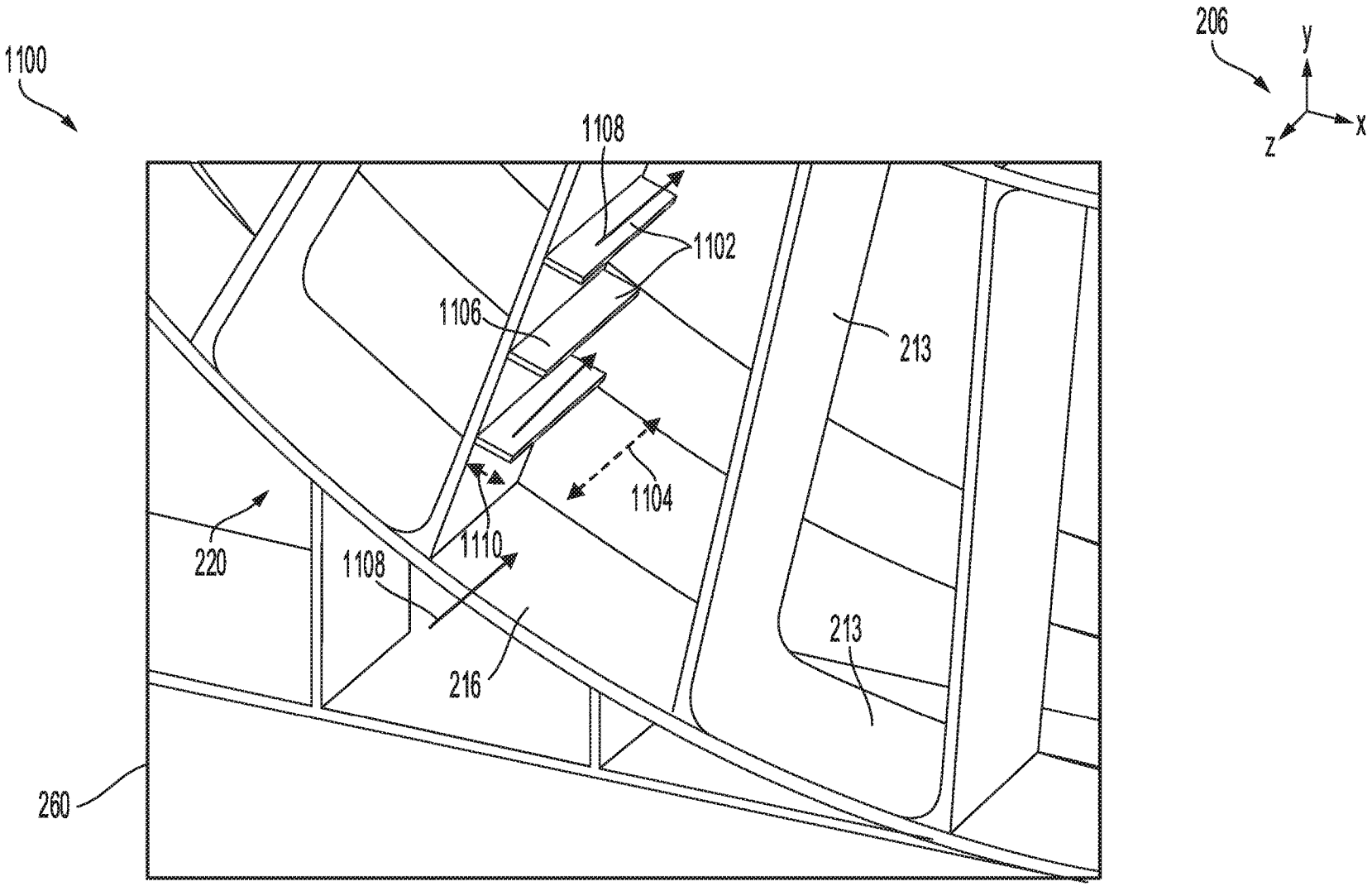
FIG. 11 shows an expanded view of a cooling channel of the cooling module assembly.

The following description relates to systems and methods for a cooling system for a vehicle. The vehicle may include a number of front end components, as shown in FIG. 1, including a cooling module assembly as a cooling system for both an engine of the vehicle and a passenger compartment. The cooling module assembly may have a semi-circular geometry with a radiator and condenser sharing a common plane, as shown in a front perspective view and rear perspective view of FIGS. 2 and 3, respectively. A direct rear view is shown in FIG. 4 with directions of flow of coolant through the radiator and refrigerant through the condenser indicated by arrows. Dispersion of loading across a structure of the cooling structure module is indicated in FIG. 5. The cooling module assembly may also include a fan tube arranged on a rear side of the cooling module assembly that flows cooling air across the cooling module assembly. A perspective view of a cross-section of the fan tube is shown in FIG. 6, illustrating an air foil-like geometry of the fan tube, the geometry depicted in further detail in a schematic illustration of a cross-section of the fan tube in FIG. 7. The radiator and condenser may be formed from hollow fins arranged in a radial pattern in the cooling module assembly that are adapted with channels for flowing fluids, such as the coolant or the refrigerant. A cross-section of one of the fins is shown in a schematic illustration in FIG. 8. An expanded view of the fins is shown in FIG. 11, depicting perpendicularly arranged vanes along surfaces of the fins. By adapting the cooling module assembly with hollow fins and positioning the radiator and condenser along the common plane, an amount of space occupied by the cooling module assembly may be reduced relative to a conventional arrangement where the radiator and condenser are stacked in front of an engine in the vehicle's front end. A profile view of the cooling module assembly is provided in FIG. 9 to illustrate a footprint of a cooling module assembly. The cooling module assembly is further depicted in FIG. 10 relative to other vehicle front end components such as various supporting structures.

FIGS. 1-11 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

FIG. 1 is a schematic depiction of an example embodiment of a vehicle cooling system 100 in a motor vehicle 102. Vehicle 102 has wheels 106, a passenger compartment 104, and an under-hood compartment 103. Under-hood compartment 103 may house various under-hood components under the hood (not shown) of motor vehicle 102. For example, under-hood compartment 103 may house an internal combustion engine 10. Internal combustion engine 10 has a combustion chamber that may receive intake air via an intake passage 44 and may exhaust combustion gases via an exhaust passage 48. In one example, intake passage 44 may be configured as a ram-air intake, wherein the dynamic pressure created by moving vehicle 102 may be used to increase a static air pressure inside the engine's intake manifold. As such, this may allow a greater mass flow of air through the engine, thereby increasing engine power. Vehicle 102 as illustrated and described herein may be a road automobile, among other types of vehicles. While the example applications of engine 10 will be described with reference to vehicle 102, it should be appreciated that various types of engines and vehicle propulsion systems may be used, including passenger cars, trucks, etc.

In some examples, vehicle 102 may be a hybrid electric vehicle (HEV) with multiple sources of torque available to one or more of wheels 106. In other examples, vehicle 102 is a conventional vehicle with only an engine or an electric vehicle with only an electric machine(s). In the example shown, vehicle 102 includes engine 10 and an electric machine 52. Electric machine 52 may be a motor or a motor/generator. A crankshaft (not shown) of engine 10 and electric machine 52 are connected via transmission 54 to vehicle wheels 106 when one or more clutches 56 are engaged. In the depicted example, a first clutch 56 is provided between engine 10 (e.g., between the crankshaft of engine 10) and electric machine 52, and a second clutch 56 is provided between electric machine 52 and transmission 54. A controller 12 may send a signal to an actuator of each clutch 56 to engage or disengage the clutch, so as to connect or disconnect the crankshaft from electric machine 52 and the components connected thereto, and/or connect or disconnect electric machine 52 from transmission 54 and the components connected thereto. Transmission 54 may be a gearbox, a planetary gear system, or another type of transmission.

The powertrain may be configured in various manners, including as a parallel, a series, or a series-parallel hybrid vehicle. In electric vehicle embodiments, a system battery 58 may be a traction battery that delivers electrical power to electric machine 52 to provide torque to vehicle wheels 106. In some embodiments, electric machine 52 may also be operated as a generator to provide electrical power to charge system battery 58, for example, during a braking operation. It will be appreciated that in other embodiments, including non-electric vehicle embodiments, system battery 58 may be a typical starting, lighting, ignition (SLI) battery coupled to an alternator 72.

Alternator 72 may be configured to charge system battery 58 using engine torque via the crankshaft during engine running. In addition, alternator 72 may power one or more electrical systems of the engine, such as one or more auxiliary systems including a heating, ventilation, and air conditioning (HVAC) system, vehicle lights, an on-board entertainment system, and other auxiliary systems based on their corresponding electrical demands. In one example, a current drawn on the alternator may continually vary based on each of an operator cabin cooling demand, a battery charging requirement, other auxiliary vehicle system demands, and motor torque. A voltage regulator may be coupled to alternator 72 in order to regulate the power output of the alternator based upon system usage requirements, including auxiliary system demands.

Under-hood compartment 103 may further include cooling system 100, which includes a cooling module assembly (CMA) 110 with an integrated radiator 80 and condenser 88. The CMA 110 may be configured as a single unit that incorporates both the radiator 80 and the condenser 88 in a continuous, unitary structure. The radiator 80 and the condenser 88 may both be arranged within an outer frame, or bolster, of the CMA 110, forming a semi-circular region of the CMA 110. The radiator 80 may be positioned above the condenser 88, both components sharing a common plane and the condenser 88 at least partially concentric about a lower, outer perimeter of the radiator 80. In other words, an upper perimeter of the condenser 88 may abut the lower perimeter of the radiator 80. For example, the radiator 80 may form an upper arc of cooling fins extending along a radial direction, and the condenser may form a lower arc, immediately below the radiator 80, of similarly radially oriented cooling fins. Further details of the CMA 110 are provided with reference to FIGS. 2 to 10 below.

The cooling system 100 circulates coolant through internal combustion engine 10 to absorb waste heat and distributes the heated coolant to the radiator 80 and/or a heater core 55 via coolant lines 82 and 84, respectively. In one example, as depicted, cooling system 100 may be coupled to engine 10 and may circulate engine coolant from engine 10 to radiator 80 via an engine-driven water pump 86 and back to engine 10 via coolant line 82. Engine-driven water pump 86 may be coupled to the engine via a front end accessory drive (FEAD) 36 and rotated proportionally to engine speed via a belt, chain, etc. Specifically, engine-driven pump 86 may circulate coolant through passages in the engine block, head, etc., to absorb engine heat, which is then transferred via radiator 80 to ambient air. In one example, where engine-driven water pump 86 is a centrifugal pump, the pressure (and resulting flow) produced by the pump may be proportional to the crankshaft speed, which in the example of FIG. 1, may be directly proportional to the engine speed. The temperature of the coolant may be regulated by a thermostat valve 38, located in cooling line 82, which may be kept closed until the coolant reaches a threshold temperature.

Coolant may flow through coolant line 82, as described above, and/or through coolant line 84 to heater core 55 where the heat may be transferred to passenger compartment 104 before the coolant flows back to engine 10. Coolant may additionally flow through a coolant line 81 and through one or more of electric machine (e.g., motor) 52 and system battery 58 to absorb heat from the one or more of electric machine 52 and system battery 58, particularly when vehicle 102 is an HEV or an electric vehicle. In some examples, engine-driven water pump 86 may operate to circulate the coolant through each of coolant lines 81, 82, and 84.

Condenser 88 is further coupled to an air conditioning (AC) system comprising a compressor 87, a receiver drier 83, an expansion valve 89, and an evaporator 85 coupled to a blower (not shown). Compressor 87 may be coupled to engine 10 via FEAD 36 and an electromagnetic clutch 76 (also known as compressor clutch 76), which allows the compressor to engage or disengage from the engine based on when the air conditioning system is turned on and switched off. Compressor 87 may pump pressurized refrigerant to condenser 88, mounted at the front of the vehicle. Condenser 88 may also be cooled by cooling fan 91, thereby, cooling the refrigerant as it flows through. The high pressure refrigerant exiting condenser 88 may flow through receiver drier 83 where any moisture in the refrigerant may be removed by the use of desiccants. Expansion valve 89 may then depressurize the refrigerant and allow it to expand before it enters evaporator 85 where it may be vaporized into gaseous form as passenger compartment 104 is cooled. Evaporator 85 may be coupled to a blower fan operated by a motor (not shown), which may be actuated by system voltage.

One or more blowers (not shown) and cooling fans may be included in cooling system 100 to provide airflow assistance and augment a cooling airflow through the under-hood components. For example, cooling fan 91, coupled to the CMA 110, may be operated when the vehicle is moving and the engine is running to provide cooling airflow assistance through the CMA 110. The cooling fan 91 may be coupled behind the CMA 110 (when looking from a grille 112 toward engine 10). In one example, as elaborated with reference to FIGS. 3-6, cooling fan 91 may be configured as a bladeless cooling fan. That is, the cooling fan may be configured to emit airflow without the use of blades or vanes, thereby creating an airflow output area that is absent of vanes or blades. Cooling fan 91 may draw a cooling airflow into under-hood compartment 103 through an opening in the front-end of vehicle 102, for example, through grille 112. Such a cooling airflow may then be utilized by radiator 80 and condenser 88, and other under-hood components (e.g., fuel system components, batteries, etc.) to keep the engine and/or transmission cool. Further, the airflow may be used to reject heat from the vehicle air conditioning system to which condenser 88 is coupled. Further still, the airflow may be used to increase the performance of a turbocharged/supercharged engine that is equipped with intercoolers that reduce the temperature of the air that goes into an intake manifold of the engine. While this embodiment depicts one cooling fan, other examples may use more than one cooling fan.

Cooling fan 91 may be coupled to battery-driven motor 93. Motor 93 may be driven using power drawn from system battery 58. In one example, system battery 58 may be charged using electrical energy generated during engine operation via alternator 72. For example, during engine operation, engine generated torque (in excess of what is required for vehicle propulsion) may be transmitted to alternator 72 along a drive shaft (not shown), which may then be used by alternator 72 to generate electrical power, which may be stored in an electrical energy storage device, such as system battery 58. System battery 58 may then be used to activate battery-driven (e.g., electric) fan motor 93. In other examples, the cooling fan may be operated by enabling a variable speed electric motor coupled to the cooling fan 91. In still other examples, cooling fan 91 may be mechanically coupled to engine 10 via a clutch (not shown), and operating the cooling fan may include mechanically powering rotation from engine rotational output via the clutch.

System voltage from the system battery 58 may also be used to operate other vehicle components such as an entertainment system (radio, speakers, etc.), electrical heaters, windshield wiper motors, a rear window defrosting system, and headlights.

FIG. 1 further shows a control system 14. Control system 14 may be communicatively coupled to various components of engine 10 to carry out the control routines and actions described herein. For example, as shown in FIG. 1, control system 14 may include controller 12. Controller 12 may be a microcomputer, including a microprocessor unit, input/output ports, an electronic storage medium for executable programs and calibration values, random access memory, keep alive memory, and a data bus. As depicted, controller 12 may receive input from a plurality of sensors 16, which may include user inputs and/or sensors (such as transmission gear position, gas pedal input, brake input, transmission selector position, vehicle speed, engine speed, engine temperature, ambient temperature, intake air temperature, etc.), cooling system sensors (such as coolant temperature, fan speed, passenger compartment temperature, ambient humidity, etc.), and others (such as Hall Effect current sensors from the alternator and battery, a system voltage regulator, etc.). Further, controller 12 may communicate with various actuators 18, which may include engine actuators (such as fuel injectors, an electronically controlled intake air throttle plate, spark plugs, etc.), cooling system actuators (such as motor actuators, motor circuit relays, etc.), and others. As an example, controller 12 may send a signal to an actuator of clutch 56 to engage or disengage the clutch, so as to connect or disconnect the crankshaft of engine 10 from transmission 54 and the components connected thereto. In some examples, the storage medium may be programmed with computer readable data representing instructions executable by the processor for performing the methods described below as well as other variants that are anticipated but not specifically listed.

Controller 12 may also adjust the operation of cooling fan 91 based on vehicle cooling demands, vehicle operating conditions, and in coordination with engine operation. In one example, during a first vehicle moving condition, when the engine is operating and vehicle cooling with airflow assistance from the fan is desired, cooling fan 91 may be powered by enabling battery-driven motor 93 to provide airflow assistance in cooling under-hood components. The first vehicle moving condition may include, for example, an engine temperature or coolant temperature that is above a threshold temperature. The threshold temperature may refer to a non-zero, positive temperature value above which airflow assistance is provided for engine cooling in order to avoid engine overheating, for example. In another example, during a second vehicle moving condition, when airflow assistance is not desired (for example, due to sufficient vehicle motion-generated airflow through the under-hood compartment), fan operation may be discontinued by disabling the fan motor.

A rise in popularity of compact, lightweight, and fuel-efficient vehicles may present challenges for automotive manufacturers to produce vehicles that meet such consumer demands while possessing sufficient space to enable packaging of indispensable vehicle components. In particular, a front end of the vehicle may house numerous parts in addition to the vehicle's engine that allow efficient and reliable operation of the vehicle. For example, a vehicle's cooling system may be arranged in the front end, as shown in FIG. 1, to maintain an engine temperature within a suitable operating range as well as to cool a passenger cabin when cooling is requested. By fluidly coupling the vehicle cooling system to the engine so that heat-absorbing fluids may be circulated through the engine, a likelihood of engine overheating is reduced.

The cooling system may rely on a CMA to extract heat from fluids flowing from the engine and from an air conditioning system. A geometry of the CMA may have a significant effect on liquid-to-air heat transfer efficiency as well as a footprint of the CMA within a vehicle under-hood compartment. As described above, a radiator and a condenser may be co-planar in the CMA. In one example, the radiator and the condenser may together form a semi-circular structure with radially oriented cooling fins. In other examples, the CMA may have a circular, oval, rectangular with clipped corners, or some other shape without corners. An example of a semi-circular CMA 202 is shown in a front perspective view 200 in FIG. 2. In one example, the CMA 202 may be the CMA 110 of FIG. 1. The CMA 202 has a central axis 204 about which the CMA 202 may be mirror-symmetric. A set of reference axes 206 is provided and indicates a y-axis, an x-axis, and a z-axis. In some examples the y-axis may be parallel with a vertical direction, the x-axis parallel with a horizontal direction, and the z-axis parallel with a transverse direction.

The CMA 202 has a bolster 203 that provides structural support to the CMA 202 by coupling directly to components within a vehicle front end to maintain a position of the CMS 202. For example, the bolster 203 may be attached to a swaybar and side aprons of the vehicle, as shown in FIG. 10 and discussed further below. The bolster includes an upper bracket 208, a lower bracket 210, and may also include a plurality of structural support-providing meridians, such as a first meridian 212, a second meridian 214, and a third meridian 216. The meridians may be inverted arcs coupled at ends of the meridians to either the upper bracket 208 or the lower bracket 210. The first meridian 212 may be an innermost meridian, e.g., coupled to and proximate to the upper bracket 208 and arcing along a first mid-point of a radius 227 of the CMA 202, the third meridian 216 may be an outermost meridian, e.g., coupled to and proximate to the lower bracket 210 and forming an outer perimeter of the CMA 202 in some regions, and the second meridian 214 may be coupled to the upper bracket 208 and disposed between the first meridian 212 and the third meridian 216. The second meridian 214 may arc along a second mid-point of the radius 227 of the CMA 202. While the CMA 202 is shown with three meridians, other examples may include more or less meridians, depending on a size of the CMA 202. For example, a larger CMA may have more meridians, such as four or five, to enhance a tensile strength of the CMA while a smaller CMA may have one or two meridians.

The upper bracket 208 may be a rigid structure extending along the x-axis that defines a top of the CMA 202 and includes wings 207 protruding out on either side of the CMA 202 perpendicular to the central axis 204. The lower bracket may also be a rigid component extending along the x-axis and defining a bottom of the CMA 202. A width, defined along the x-axis, of the lower bracket 210 may be narrower than the upper bracket 208. The upper bracket 208 may configured to withstand higher loads, e.g. be more durable and strong, than the lower bracket 210 due to a proximity of the upper bracket 208 to a hood of the vehicle. The upper bracket 208 may absorb at least a portion of an impact generated by closing the hood, where a downwards motion of the hood is compelled by gravity. A hood latch recess 205 is included in the upper bracket 208 to accommodate a positioning of a hood latch against the upper bracket 208 when the hood is closed. The hood latch recess 205 may be disposed in a front surface 219 of the upper bracket 208, in a central region 209 of the upper bracket 208. A width of the hood latch recess 205, defined along the x-axis, may be much narrower than a width of the upper bracket 208 or of the lower bracket 210. A height of the hood latch recess 205, defined along the y-axis, may extend down from an upper surface 221 of the upper bracket 208 but extend a portion of and not along an entire height 223 of the upper bracket 208. A depth of the hood latch recess 205, defined along the z-axis, may extend into a portion of a thickness 225 of the upper bracket 208 from the front surface 219 of the upper bracket 208. The hood latch recess 205 may be configured to provide clearance for the hood latch to couple to a reciprocating mechanism in the vehicle front end to maintain the hood closed against vehicle motion until the hood latch is released by an operator.

The meridians may be concentric along the central axis 204 and co-planar with the y-x plane, configured as inverted arcs framing cooling fins of the CMA 202. The CMA 202 includes a radiator 218 forming a first set of fins 211 (hereafter, radiator fins 211), indicated by cross-hatching, and a condenser 220 forming a second set of fins 213 (hereafter condenser fins 213). The radiator 218 and the condenser 220 are aligned to share a common plane (co-planar with the y-x plane), e.g., not stacked and the radiator 218 is positioned above the condenser 220, relative to y-axis. The condenser 220 is at least partially concentric about the radiator 218, forming an outer arc of fins and the radiator 218 forming an inner arc of fins. In other examples, however, the positioning of the condenser 220 and the radiator 218 may be reversed, with the radiator 218 former the outer arc and the condenser 220 forming the inner arc.

The radiator fins 211 of the radiator 218 may extend radially, relative to the central axis 204, from the central region 209 of the upper bracket 208, towards the third meridian 216. All of the radiator fins may extend through the first meridian 212 and continue to at least the second meridian 214. For example, the first meridian 212 may have a plurality of slots disposed along an entire circumference of the first meridian 212 and shaped to match a cross-sectional geometry of the radiator fins 211. The radiator fins 211 may be inserted through the plurality of slots so that the radiator fins 211 extend continuously through the first meridian 212 to either the second meridian 214 or the third meridian 216. For example, a central portion 222 of the radiator fins 211 may extend as far as the second meridian 214 while peripheral portions 224 of the radiator fins 211 may extend through a plurality of slots in the second meridian 214, similar to the plurality of slots in the first meridian 212, to continue to the third meridian 216.

The condenser fins 213 of the condenser 220 may extend radially from the second meridian 214 to the third meridian 216, and between the peripheral portions 224 of the radiator fins 211. Both the radiator fins 211 and the condenser fins 213 may have similar depths, defined along the z-axis, and thicknesses, defined along the x-axis. The radiator fins 211 and condenser fins 213 may also be similarly configured to flow fluid through continuous inner passages of the fins.

Each of the radiator 218 and the condenser 220 may be formed from a single strip of material, folded in a sinusoidal pattern to form the respective sets of fins. In other words, the radiator 218 may have a first meander line, meandering between the upper bracket 208 and the first meridian 214, and the condenser 220 may have a second meander line, meandering between the first meridian 214 and the second meridian 216. For example, a geometry of a portion of the radiator fins 211 is indicated by arrow 226 and a geometry of a portion of the condenser fins 213 is indicated by arrow 228. To continuously flow fluid through each of the radiator 218 and the condenser 220, each of the sets of fins may be adapted with inner passages extending entirely throughout the strip of material forming each set of fins. As such, the radiator fins 211 and the condenser fins 213 are also cooling channels that flow coolant and refrigerant, respectively, throughout the sinusoidal sets of fins. The radiator fins 211 and the condenser fins 213 may be configured to maintain separation between the coolant and refrigerant so that the coolant and refrigerant do not mix at any point while flowing through the CMA 202.

In some examples, at least some of the radiator fins 211 and/or the condenser fins 213 may be configured as load-bearing fins rather than fluid-flowing fins. For example one fin 215 of the radiator fins 211 aligned along the central axis 204 may be load-bearing without an inner passage, branching from the radiator fins 211 that form a continuous cooling channel. Similarly, one fin 217 of the condenser fins 213, also aligned along the central axis 204 and branching from the fluid-slowing condenser fins 213, may be load-bearing rather than fluid-flowing. However, in some examples, the load-bearing radiator fins 211 may not be aligned with the load-bearing condenser fins 213 and instead offset, e.g., staggered relative to the load-bearing radiator fins 211. In other examples, every third, fourth, or fifth fin of the radiator and/or condenser fins may be a load-bearing fin. A number of load-bearing fins may be varied depending on an anticipated amount of load exerted on the CMA 202. Furthermore, dimensions of the fins may be adjusted based on an engine size and amount of desired cooling provided by the radiator 218. For example, the radiator fins 211 may be adapted to be longer (in a radial direction), deeper, along the z-axis, or have more densely arranged if the CMA 202 is to be installed in a vehicle with a large engine, such as a truck.

Figure 2:
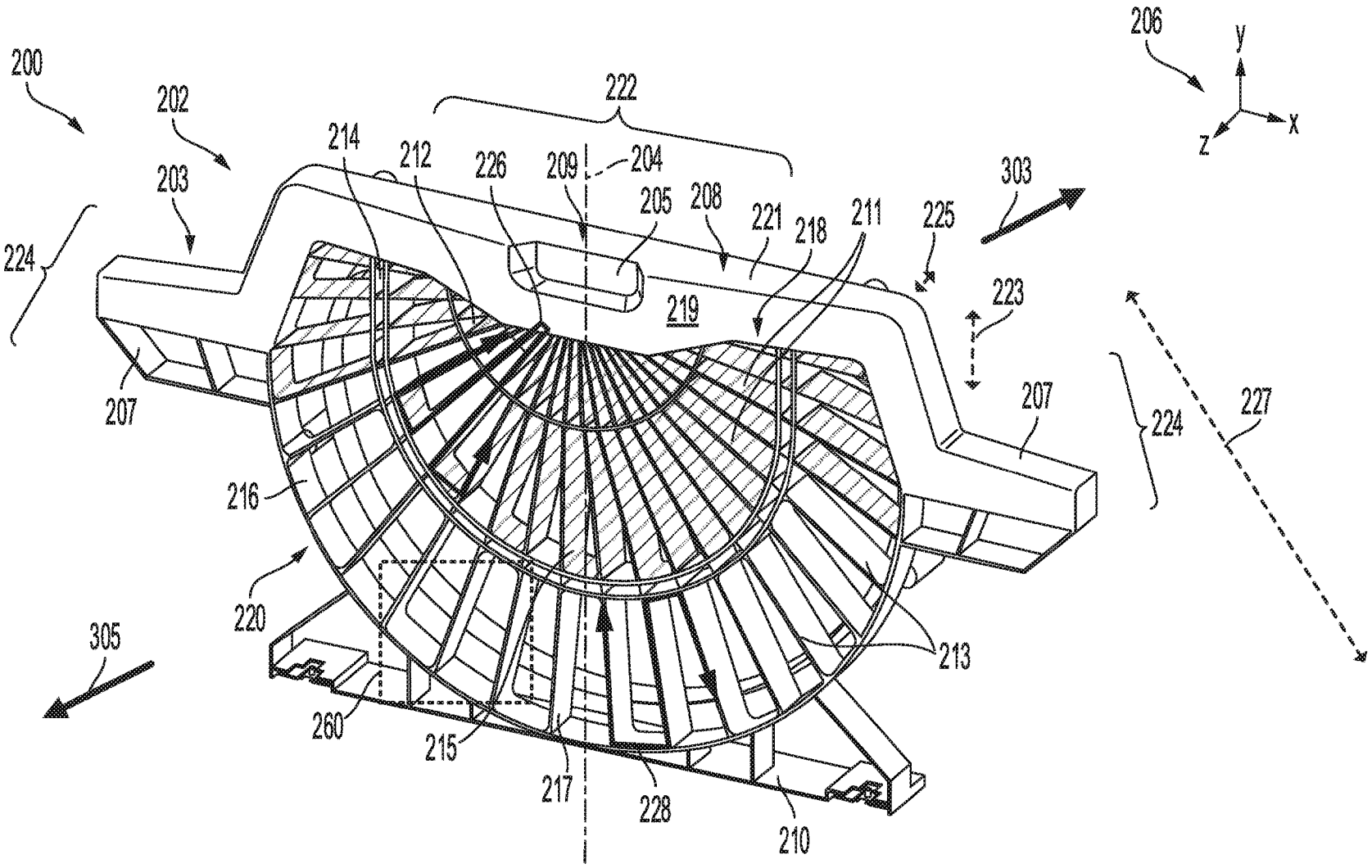
FIG. 2 shows a perspective front view of an example cooling module assembly that may be included in the vehicle.
Figure 3:
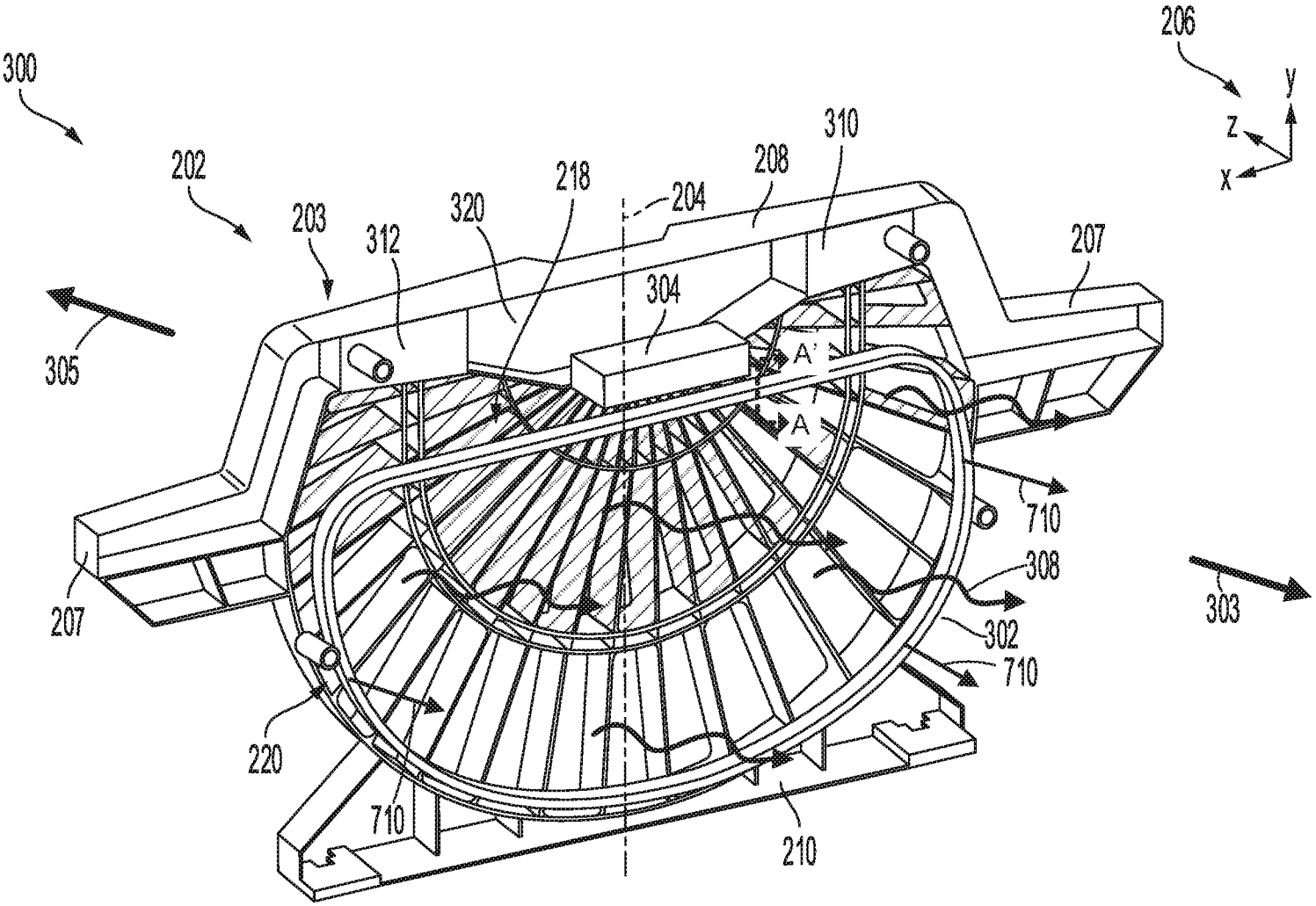
FIG. 3 shows a perspective rear view of the cooling module assembly.

The CMA 202 may include additional components, as shown in a rear perspective view 300 of FIG. 3. An air multiplier 302, which may be a bladeless fan used similarly as the cooling fan 91 of FIG. 1, may be positioned along a rear-side 303 of the CMA 202, arranged co-planar with the CMA 202. A front side 305 of the CMA 202 is also indicated in FIGS. 2-3. The air multiplier 302 have also have a semi-circular geometry and may be formed from a single continuous hollow tube. The air multiplier 302 may be directly coupled to a fan box 304 adapted to house an electric fan that drives air flow through the air multiplier 302, e.g. air flow continuously from the fan box 304 through the air multiplier 302 as driven by the electric fan. By configuring the CMA 202 with an air multiplier 302, a smaller fan and fan motor may be used relative to a conventional system where a condenser is stacked in front of a radiator and a fan positioned behind the radiator. Furthermore, the semi-circular shape of the CMA 202 and matching geometry of the air multiplier 302 eliminates a presence of regions of the CMA 202 that do not receive sufficient air flow from the fan. This enables more efficient liquid-to-air heat exchange, relative to corners of a radiator having a square or rectangular configuration.

A continuous slit 306 may extend through an entire length of the air multiplier 302, coupling air inside the air multiplier 302 to air external to and surrounding the air multiplier 302. A first cross-section 600 of the air multiplier 302, taken along line A-A' in FIG. 3, is shown in FIG. 6 from a perspective view. Turning now to FIG. 6, the first cross-section 600 illustrates a similarity of a shape of the air multiplier 302 to an air foil. The air multiplier 302 is hollow, with a non-continuous shell 602, the shell 602 interrupted by the slit 306. At the slit 306, the shell 602 of the air multiplier 302 may be offset so that a first edge 604 and a second edge 606 of the shell 602 are not aligned. The slit 306 is formed by the opening created by the offset of the first edge 604 from the second edge 606.

Figure 7:
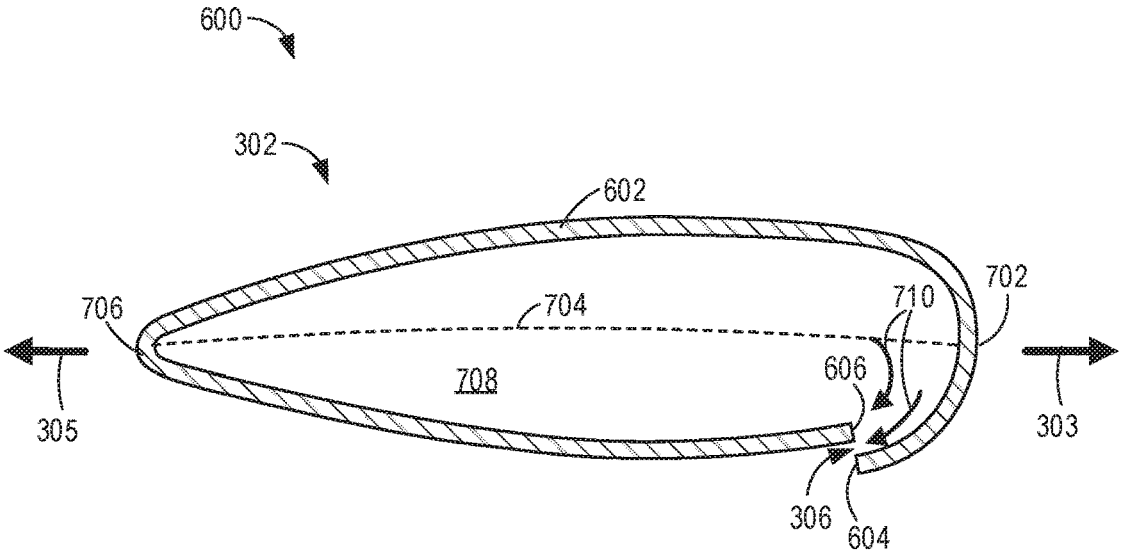
FIG. 7 shows a schematic illustration of a cross-section of the fan tube.

The geometry of the shell 602 of the air multiplier 302 is depicted in further detail in a second cross-section 700 of FIG. 7. The air multiplier 302 has a broad end 702 that tapers along a camber line 704 to a narrow end 706. When attached to the CMA, e.g., the CMA 202 of FIGS. 2 and 3, the air multiplier 302 may be oriented so that the narrow end 706 of the shell 602 is pointing towards the front side 305 of the CMA and closer to the CMA than the broad end 702. The slit 306 is positioned proximate to the broad end 702 and is thus oriented further away from the rear side 303 of the CMA than the narrow end 706 of the shell 602.

As high velocity air is pushed into the air multiplier by the electric fan, air flows through an interior 708 of the air multiplier 302, increasing pressure within the air multiplier 302. The rising pressure may force air out of the air multiplier 302 through the slit 306, as indicated by arrows 710 shown in both FIGS. 3 and 7. As shown in FIG. 3, the air exiting the air multiplier 302 through the slit 306 flows away from the CMA 202 along the z-axis. The flow, indicated by arrows 710 entrains additional air flow, flowing through a region of the CMA 202 between the upper bracket 208 and the lower bracket 210 and between the wings 207 of the bolster 203, and the air multiplier 302, as indicated by arrows 308. The air multiplier 302 thereby increases air flow through the CMA 202 and across the radiator fins 211 and the condenser fins 213, enhancing liquid-to-air heat transfer from fluids flowing through the radiator fins 211 and the condenser fins 213 to the entrained air flowing through spaces between the fins when the electric fan is activated and driving air flow through the air multiplier 302. The electric fan may be operated during events where ram-air flow through the under-hood compartment of the vehicle is low, such as during idling. When the vehicle is in motion and ram-air flow through the under-hood compartment is high, the electric fan may be deactivated.

Returning to FIG. 3, the CMA 202 further includes a coolant inlet reservoir 310 and a coolant outlet reservoir 312 which may be tanks configured to store coolant positioned in the upper bracket 208 of the bolster 203 along a rear-facing surface 320 of the upper bracket 208. The coolant inlet reservoir 310 and the coolant outlet reservoir 312 may be fluidly coupled to the radiator 218, the coolant inlet reservoir 310 storing coolant received from an engine block and the coolant outlet reservoir 312 storing coolant that has passed through the radiator. The radiator 218 and the condenser 220 may both have inlets and outlets to allow coupling of the radiator 218 and the condenser 220 to coolant and refrigerant lines, respectively. The inlets and outlets may be arranged along the rear side 303 of the CMA 202, as shown in a first rear view 400 of the CMA 202 in FIG. 4.

Turning to FIG. 4, the first rear view 400 of the CMA 202 shows a radiator inlet 402 coupled to the coolant inlet reservoir 310 proximate to a first end 403 of the bolster 203 at the upper bracket 208. Coolant may flow into the radiator inlet 402 as indicated by arrow 404 and continue into coolant inlet reservoir 310 of the radiator 218 and into the cooling channel that forms the radiator fins 211. The coolant flow may follow a sinusoidal path, as indicated by arrows 406, across the CMA 202 along the x-axis, until the coolant reaches the coolant outlet reservoir 312 proximate to a second end 405 of the bolster 203 at the upper bracket 208, the second end 405 opposite of the first end 403. A radiator outlet 408 is coupled to the coolant outlet reservoir 312 and the coolant flows out of the radiator 218 through the radiator outlet 408, as indicated by arrow 410, to return to the engine block.

The condenser 220 also has a condenser inlet 412 that couples to refrigerant lines of an air conditioning system. Refrigerant may flow into the condenser at the condenser inlet, as indicated by arrow 414, proximate to a first end 403 of the bolster 203. The refrigerant flows along a sinusoidal path, similar to the coolant in the radiator 218, as shown by arrows 416, from the first end 403 to the second end 405 of the bolster 203 along the x-axis. Proximate to the second end 405 of the bolster 203, the refrigerant flows out of the condenser at a condenser outlet 418 as indicated by arrow 420 to be recirculated through the air conditioning system.

While the radiator inlet 402 and the condenser inlet 412 are arranged proximate to the first end 403 of the bolster 203 in FIG. 4, it will be appreciated that the CMA shown in FIG. 4 is a non-limiting example. Other embodiments of the CMA may have the radiator inlet 402 and the condenser inlet 412 proximate to the second end 405 of the bolster 203 or at opposite ends of the CMA, e.g., the radiator inlet 402 is at the first end 403 and the condenser inlet is at the second end 405 or vice versa. Furthermore, proportioning of a radius 430 of the CMA 202 between the condenser 220 and the radiator 218 may vary from that shown in the figures described herein. The radius 430 may be divided so that 60% of the radius 430 is formed by the radiator 218 and 40% of the radius 430 is formed from the condenser 220. In another example, the radiator 218 and the condenser 220 may each form 50% of the radius 430 of the CMA 202. In another example, the radiator 218 may form 30% of the radius 430 and the condenser 220 may form 70% of the radius 430, or the radiator 218 may form 80% of the radius 430 and the condenser 220 may form 20% of the radius 430 of the CMA 202. Other variations in the proportioning of the CMA radius 430 between the radiator fins 211 and the condenser fins 213 have been contemplated.

The radiator 218 and the condenser 220 may form fins by folding a cooling channel into a sinusoidal geometry, as described above. The cooling channel of the radiator 218 may include an inner passage for flowing coolant, the inner passage extending entirely through the radiator fins 211. Similarly, the cooling channel of the condenser 220 may include an inner passage for flowing refrigerant, the inner passage extending entirely through the condenser fins 213. A positioning of an inner passage within a cooling channel of a condenser of a CMA is shown in a cross-section 800 of a fin 802 formed from the cooling channel. The cross-section may be taken along line B-B' in FIG. 4 of one of the condenser fins 213. A cross-section of one of the radiator fins 211 may be similarly represented.

Figure 8:
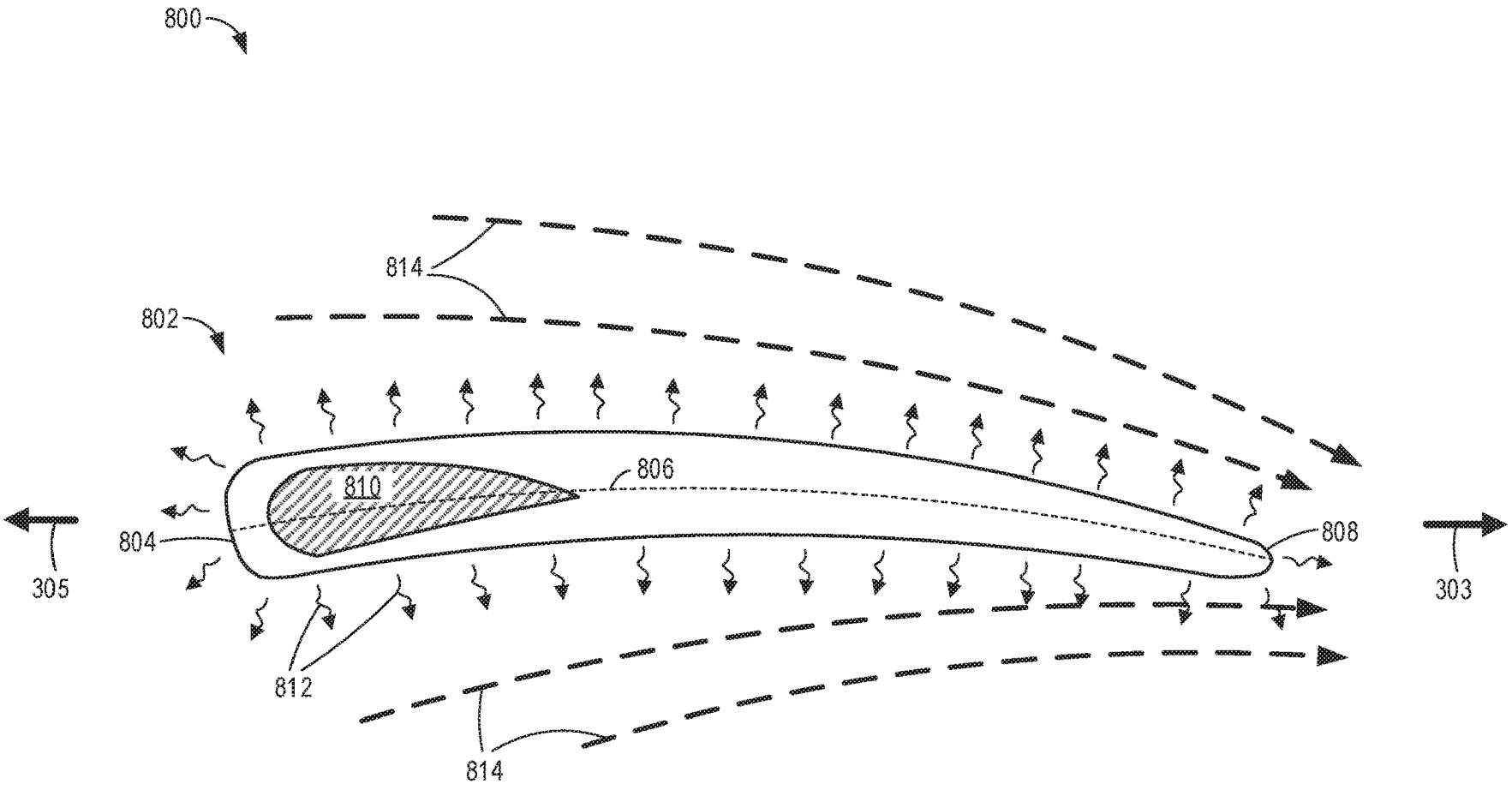
FIG. 8 shows a schematic illustration of a cross-section of a fin of the cooling module assembly.

Turning now to FIG. 8, the fin 802, similar to the air multiplier 302, is shaped as an air foil with a broader, leading edge 804 that tapers along a camber line 806 to a narrow trailing edge 808. Between the leading edge 804 and the trailing edge 808, the fin 802 is curved, the curvature depicted by the camber line 806. The fin 802 may be oriented in the CMA so that the leading edge 804 is at the front side 305 of the CMA and the trailing edge 808 is at the rear side 303 of the CMA.

An inner passage 810 is disposed within a material of the fin 802, forming a chamber within the fin 802. The inner passage 810 has a geometry resembling a teardrop turned sideways in FIG. 8 but may have a variety of alternate shapes, such as oval, a rectangular with rounded corners, triangular, elliptical, etc. Fluid, such as refrigerant (or coolant if the fin is a radiator fin), may flow through the inner passage 810, thus the inner passage 810 may have smooth surfaces to minimize friction between the surfaces and the fluid. The fin 802 may be formed from a durable, rigid, heat conductive material, such as a composite or a metal. As heated fluid passes through the inner passage 810 of the fin 802, the heat is conducted from the fluid through the material of the fin and radiated from the fin 802 as shown by arrows 812. The radiating heat is transferred to air flowing past the fin 802 via convection. Efficient extraction of heat is thus dependent upon flow of air past the fin 802 and a ratio of surface area of the fin 802 relative to fluid volume within the inner passage 810 to maximize absorption of heat from the fluid and provide a large surface area of the fin 802 in contact with cooling air flow.

The air foil shape of the fin 802 allows the fin 802 to have a large surface area relative to a volume of the fin 802 as well as a volume of the inner passage 810, enabling efficient transfer of heat. The shape of the fin 802 also creates a pressure differential across a length of the fin 802, e.g., along the camber line 806. For example, at the front side 305 of the CMA where the leading edge 804 of the fin 802 is positioned, the broadness of the leading edge 804 may reduce spaces between the radiator fins and between the condenser fins, resulting in higher pressure relative to the rear side of the CMA. At the rear side of the CMA, trailing edges, e.g., the trailing edge 808 of the fin 802, of the radiator fins and the condenser fins have larger interstitial spaces, resulting in a lower air pressure at the rear side of the CMA compared to the front side. The pressure gradient draws air through the CMA, enabling smoother air flow between the fins than if the fins each had a uniform width along a camber line of the fins. The pressure gradient may also enhance convective heat transfer.

The radiator 218 and the condenser 220 may be further adapted with vanes, arranged parallel with the direction of air flow through the CMA 202 to increase the surface area of the radiator 218 and the condenser 220 and to assist in guiding air flow across the surfaces of the radiator 218 and the condenser 220. Dashed rectangle 260 indicated in FIG. 2 is depicted in an expanded view 1100 in FIG. 8. While the expanded view 1100 of FIG. 11 shows a portion of the condenser 220, the radiator 218 may be similarly represented.

In FIG. 1, rectangular vanes 1102 may protrude from sides of the the fins 213 of the condenser 220, each of the vanes 1102 spaced evenly apart from adjacent vanes 1102. The vanes 1102 may have a similar depth 1104, along the z-axis, as the fins 213 and may extend perpendicularly along the x-axis from the fins 213 into spaces between the fins 213. Extension of the vanes 1102 from the fins 213 along the x-axis positions the vanes 1102 so that planar surfaces 1106 (co-planar with the x-z plane) of the vanes 1102 are in contact with air flowing through the CMA 202 in the direction indicated by arrows 1108.

Three vanes 1102 are illustrated in FIG. 8 for simplicity but the condenser 220 may include any number of vanes 1102 disposed along the fins 213 of the condenser 213. For example, each of the fins 213 may have one to six vanes 1102 coupled to surfaces of the fins 406, arranged perpendicular to air flow. The vanes 1102 may extend from one surface of the fins 213 or both surfaces of the fins 213, e.g., from both oppositely arranged faces of the fins 213 in opposite directions along the x-axis. A length 1110 of the vanes 1102 may vary according to dimensions of the condenser 220. For example, the vanes 802 may be 0.25 mm in length 1110 but may increase for a larger radiator or a radiator with thicker/wider fins 213. In this way, the vanes 1102 increase an overall surface area of the condenser 220, enhancing convective transfer of heat from the condenser 220 to the air flowing across the condenser 220.

In addition to increasing cooling efficiency of a CMA, a semi-circular geometry of the CMA may allow a structure of the CMA to absorb loads imposed on the CMA in a downwards direction relative to the y-axis by, for example, closing of a vehicle hood or bouncing of the vehicle while navigating uneven terrain. As an example, when the vehicle hood is closed, a weight of the hood applies a downwards force on the upper bracket 208 of the bolster 203 of the CMA 202, as shown in a second rear view 500 of the CMA 202 in FIG. 5. The downward force exerted on the bolster 203 at the hood latch recess 205 is indicated by arrow 502.

The radially arranged fins of the radiator 218 and the condenser 220 direct the downwards force along the fins and along the upper bracket 208 and the lower bracket 210 of the bolster 203 as shown by arrows 504. The load is distributed downwards along the wings 207 of the upper bracket 208 and along each of the fins towards the lower bracket 210 so that the force is dispersed and absorbed evenly across the bolster 203, including the first meridian 212, the second meridian 214, and the third meridian 216. The load transmitted through the fins of the radiator 218 and the condenser 220, which may also include fins configured to be load-bearing and without an inner passage, reaches the lower bracket 210 and is absorbed by the lower bracket 210. At the wings 207, the force may be transferred to adjacent components of the vehicle front end positioned immediately below the wings 207 and adapted to absorb force from the wings 207, such as crush cans 506.

As depicted in FIG. 5, the shape of the CMA 202 is configured to withstand applied loads while increasing a cooling effect of the CMA 202 on coolant flowing through the radiator 218 and refrigerant flowing through the condenser 220. The geometry of the CMA 202 also enables the CMA to have a reduced footprint compared to a conventional cooling system, as illustrated in a profile view 900 of the CMA 202 in FIG. 9. The profile view 900 of the CMA 202 shows a compact profile of the CMA 202. A conventional stacking of components 902, such as a condenser, a charge air cooler, and other auxiliary coolers, in front of a radiator is eliminated by integrating the condenser and radiator into one unit sharing a common plane. By positioning the radiator and the condenser co-planar, a footprint of the CMA is reduced, freeing space within the vehicle front end for other components. In addition, the CMA may be additively manufactured, such as by 3-D printing, as a single unit, thereby reducing costs associated with fabrication and assembly.

An arrangement of the CMA 202 within a front end structure 1000 of a vehicle is shown in FIG. 10. The front end structure 1000 may be disposed in an under-hood compartment of the vehicle, such as the under-hood compartment 103 of FIG. 1. The CMA 202 is positioned at a forwards region of the front end structure 1000, immediately behind a front bumper beam 1006. An engine may be located in a space behind the CMA 202. Crush cans 1008 may be disposed below the wings 207 of the upper bracket 208 of the CMA 202 to absorb impact transmitted through the front bumper beam 1006 and through the CMA 202.

The CMA 202 may be secured in place within the front end structure 1000 by coupling the lower bracket 210 to a swaybar 1010. The wings 207 of the CMA 202 may be attached to side aprons 1012 of the front end structure 1000. A position of the CMA 202 is thus maintained despite bouncing of the vehicle during operation and vibrations transmitted to the CMA 202 from mechanical and electrical components of the vehicle.

In this way, a cooling system of a vehicle may utilize a cooling module assembly (CMA) to efficiently cool an engine and a passenger cabin with a reduced footprint in the vehicle's front end compartment. The CMA includes a radiator and a condenser, both the radiator and the condenser formed from a continuous cooling channel adapted with an inner passage for flowing a fluid and folded into a sinusoidal geometry. The folded cooling channel is arranged so that the cooling channel forms radially aligned fins, the radially aligned fins of the radiator and the condenser forming a semi-circular structure. The fins, from a cross-sectional perspective, may have an air foil shape that increases liquid-to-air heat exchange and promotes smooth air flow through the CMA across surfaces of the fins. The radiator is positioned above the condenser and in line with the condenser so that the radiator and the condenser share a common plane. As a result of the arrangement of the radiator and condenser, the radiator and condenser receive equivalent contact with cooling air flow, thereby increasing heat extraction from radiator coolant compared to conventional cooling systems where the condenser is stacked in front of the radiator. The CMA may also include an air multiplier coupled to a rear side of the CMA that enhances air flow through the CMA when air flow into the vehicle front compartment as compelled by motion of the vehicle is low. The CMA thereby enhances a cooling efficiency of both the radiator and condenser while maintaining a low footprint within the front compartment of the vehicle.

The technical effect of configuring a vehicle with the semi-circular cooling module assembly is that a cooling efficiency of the radiator and condenser is enhanced while allowing for a cooling assembly that occupies less packing space.

As a first embodiment, an integrated cooling system includes an upper and a lower support bracket, and a passage assembly including a first continuous passage coupled to the upper bracket as a first meander line having a first radius, the first passage circulating a first fluid; and a second continuous passage coupled to the upper bracket as a second meander line having a second radius, larger than the first radius, the second passage circulating a second fluid, wherein the first passage is co-planar with the second passage. In a first example of the cooling system, the first passage has an inlet and outlet coupled to the upper bracket and wherein the first meander line generates a first set of radiating fins having the first radius. A second example of the cooling system optionally includes the first example, and further includes wherein the second passage has an inlet and outlet coupled to a meridian extending between the upper bracket and the lower bracket and wherein the second meander line generates a second set of radiating fins having the second radius. A third example of the cooling system optionally includes one or more of the first and second examples, and further includes, wherein the first meander line having the first radius extends from the upper bracket to a mid-point between the upper bracket and the lower bracket, and wherein the second meander line extends from the mid-point to the lower bracket. A fourth example of the cooling system optionally includes one or more of the first through third examples, and further includes, wherein the first fluid circulating through the first passage is maintained separate from the second fluid circulating through the second passage across entire lengths of both the first passage and the second passage. A fifth example of the cooling system optionally includes one or more of the first through fourth examples, and further includes, wherein a periphery of the cooling system is defined by the upper and lower support bracket and a circumference of the passage assembly. A sixth example of the cooling system optionally includes one or more of the first through fifth examples, and further includes, wherein the upper support bracket includes a pair of wings extending along a horizontal direction in opposite directions away from a central region of the upper bracket and a recess configured to couple with a fastening latch of a vehicle hood. A seventh example of the cooling system optionally includes one or more of the first through sixth examples, and further includes, wherein the meandering first passage forms a first set of radially aligned fins and the meandering second passage forms a second set of radially aligned fins, the first set of fins circumferentially surrounded by the second set of fins and together forming a semi-circular structure. An eighth example of the cooling system optionally includes one or more of the first through seventh examples, and further includes, wherein each of the first set of fins and the second set of fins are shaped as air foils with a broader edge of the air foils arranged at a front side of the cooling system and a tapered edge of the air foils extending towards a rear side of the cooling system. A ninth example of the cooling system optionally includes one or more of the first through eighth examples, and further includes, wherein the first set of fins and the second set of fins include rectangular vanes extending perpendicularly from surfaces of the fins and arranged perpendicular to a flow of air across surfaces of the fins. A tenth example of the cooling system optionally includes one or more of the first through ninth examples, and further includes, a bladeless fan configured as a hollow tube arranged in a semi-circular shape with a slit extending entirely along a length of the air multiplier facing a rear side of the cooling system and wherein the bladeless fan has a cross-section shape of an air foil.

In another embodiment, an integrated cooling system module for a vehicle includes a bolster defining an outer perimeter of the cooling system module, a first passage arranged sinusoidally between a first fluid inlet and a first fluid outlet to form a first region of radially-extending fins, the first region having a first circumference, the first inlet and outlet coupled to the bolster, and a second passage arranged sinusoidally between a second fluid inlet and a second fluid outlet to form a second region of radially-extending fins, the second region having a second circumference, larger than the first circumference, the second inlet and outlet coupled to the bolster, wherein the second region abuts the first region to form a radial co-planar structure framed by the bolster. In a first example of the cooling system module, first passage is a radiator circulating coolant and wherein the second passage is a condenser circulating refrigerant. A second example of the cooling system module optionally includes the first example, and further includes wherein the bolster includes an upper bracket arranged above the first passage and the second passage, a lower bracket arranged below the first passage and the second passage, a first meridian arcing through a mid-point of a radius of the integrated cooling system module, and a second meridian extending between the upper bracket and the lower bracket. A third example of the cooling system module optionally includes one or more of the first and second examples and further includes, wherein the first passage meanders between the upper bracket and the first meridian and the second passage meanders between the first meridian and the second meridian. A fourth example of the cooling system module optionally includes one or more of the first through third examples, and further includes, wherein at least one fin of the first region of fins and at least one fin of the second region of fins is configured to be load-bearing. A fifth example of the cooling system module optionally includes one or more of the first through fourth examples, and further includes, a bladeless fan coupled to a rear side of the cooling system module, the bladeless fan configured to entrain air through a central region of the cooling system module. A sixth example of the cooling system module optionally includes one or more of the first through fifth examples, and further includes, wherein a load imposed on the cooling system module at the upper bracket of the bolster is distributed uniformly across the cooling system module to the lower bracket of the bolster.

As another embodiment, a cooling system includes a first heat exchanger formed from a plurality of fins arranged in a semi-circle, a second heat exchanger positioned along an outer perimeter of the first heat exchanger, the second heat exchanger also formed from a plurality of fins arranged in a semi-circle, and a rigid supporting structure configured to couple the cooling system to a vehicle front end. In a first example of the cooling system, the cooling system is configured to be 3-D printable as an integrated unit.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An integrated cooling system, comprising:

an upper and a lower support bracket; and a passage assembly including a first continuous passage coupled to the upper bracket as a first meander line having a first radius, the first passage circulating a first fluid; and a second continuous passage coupled to the upper bracket as a second meander line having a second radius, larger than the first radius, the second passage circulating a second fluid, wherein the first passage is co-planar with the second passage.

2. The integrated cooling system of claim 1, wherein the first passage has an inlet and outlet coupled to the upper bracket and wherein the first meander line generates a first set of radiating fins having the first radius.

3. The integrated cooling system of claim 2, wherein the second passage has an inlet and outlet coupled to a meridian extending between the upper bracket and the lower bracket and wherein the second meander line generates a second set of radiating fins having the second radius.

4. The integrated cooling system of claim 3, wherein the first meander line having the first radius extends from the upper bracket to a mid-point between the upper bracket and the lower bracket; and wherein the second meander line extends from the mid-point to the lower bracket.

5. The integrated cooling system of claim 1, wherein the first fluid circulating through the first passage is maintained separate from the second fluid circulating through the second passage across entire lengths of both the first passage and the second passage.

6. The integrated cooling system of claim 1, wherein a periphery of the cooling system is defined by the upper and lower support bracket and a circumference of the passage assembly.

7. The integrated cooling system of claim 6, wherein the upper support bracket includes a pair of wings extending along a horizontal direction in opposite directions away from a central region of the upper bracket and a recess configured to couple with a fastening latch of a vehicle hood.

8. The integrated cooling system of claim 1, wherein the meandering first passage forms a first set of radially aligned fins and the meandering second passage forms a second set of radially aligned fins, the first set of fins circumferentially surrounded by the second set of fins and together forming a semi-circular structure.

9. The integrated cooling system of claim 8, wherein each of the first set of fins and the second set of fins are shaped as air foils with a broader edge of the air foils arranged at a front side of the cooling system and a tapered edge of the air foils extending towards a rear side of the cooling system.

10. The integrated cooling system of claim 9, wherein the first set of fins and the second set of fins include rectangular vanes extending perpendicularly from surfaces of the fins and arranged perpendicular to a flow of air across surfaces of the fins.

11. The cooling system of claim 1, further comprising a bladeless fan configured as a hollow tube arranged in a semi-circular shape with a slit extending entirely along a length of the air multiplier facing a rear side of the cooling system and wherein the bladeless fan has a cross-section shape of an air foil.

12. An integrated cooling system module for a vehicle, comprising:

a bolster defining an outer perimeter of the cooling system module;

a first passage arranged sinusoidally between a first fluid inlet and a first fluid outlet to form a first region of radially-extending fins, the first region having a central portion with a first circumference, the first inlet and outlet coupled to the bolster; and a second passage arranged sinusoidally between a second fluid inlet and a second fluid outlet to form a second region of radially-extending fins, the second region having a second circumference, larger than the first circumference, the second inlet and outlet coupled to the bolster; wherein the second region abuts the first region to form a radial co-planar structure framed by the bolster.

13. The integrated cooling system module of claim 12, wherein the first passage is a radiator circulating coolant and wherein the second passage is a condenser circulating refrigerant.

14. The integrated cooling system module of claim 13, wherein the bolster includes an upper bracket arranged above the first passage and the second passage, a lower bracket arranged below the first passage and the second passage, a first meridian arcing through a mid-point of a radius of the integrated cooling system module, and a second meridian extending between the upper bracket and the lower bracket.

15. The integrated cooling system module of claim 13, wherein the central portion of the first passage meanders between the upper bracket and the first meridian and the second passage meanders between the first meridian and the second meridian.

16. The integrated cooling system module of claim 12, wherein at least one fin of the first region of fins and at least one fin of the second region of fins is configured to be load-bearing.

17. The integrated cooling system module of claim 12, further comprising a bladeless fan coupled to a rear side of the cooling system module, the bladeless fan configured to entrain air through a central region of the cooling system module.

18. The integrated cooling system module of claim 13, wherein a load imposed on the cooling system module at the upper bracket of the bolster is distributed uniformly across the cooling system module to the lower bracket of the bolster.

* * * * *